United States Patent [19]

Gassaway

[11] Patent Number: 4,713,960

[45] Date of Patent: Dec. 22, 1987

[54] METHOD FOR FORMING A COUNTERSINK IN A PLATE

[76] Inventor: J. Scott Gassaway, 2356 Glendon, Los Angeles, Calif. 90064

[21] Appl. No.: 894,967

[22] Filed: Aug. 8, 1986

Related U.S. Application Data

[62] Division of Ser. No. 562,849, Dec. 19, 1983, Pat. No. 4,634,009.

[51] Int. Cl.[4] ..... B21D 53/00

[52] U.S. Cl. ..... 72/412; 72/359; 72/470; 72/379

[58] Field of Search ..... 72/335, 324, 341, 412, 72/470, 476, 479, 359, 379, 358; 29/163.5 R, 557

[56] References Cited

U.S. PATENT DOCUMENTS

| | | | |
|---|---|---|---|
| 2,306,658 | 12/1942 | Willard | 72/358 |
| 3,201,967 | 8/1965 | Balamuth et al. | 72/359 |
| 3,223,245 | 12/1965 | Weitzman | 211/4 |
| 3,967,669 | 7/1976 | Egner | 29/509 |
| 4,072,039 | 2/1978 | Nakanishi | 72/335 |
| 4,268,099 | 5/1981 | Clausen | 248/551 |
| 4,430,878 | 2/1984 | Dispennett et al. | 72/340 |
| 4,501,512 | 2/1985 | Hiltz | 403/263 |

FOREIGN PATENT DOCUMENTS

| | | | |
|---|---|---|---|
| 691234 | 10/1979 | U.S.S.R. | 72/470 |

*Primary Examiner*—Daniel C. Crane
*Attorney, Agent, or Firm*—Donald D. Mon

[57] ABSTRACT

A method of forming a countersink around a hole in a metal plate. A stepped punch is pressed, stem first into the hole, with such a force and at such a rate as to cause deformation but not shearing of the metal, there being an annular ring of unrestrained surface around the hole at the backside of the plate. The resulting countersink has cold-worked surfaces, and a raised ring is formed on the backside of the plate.

2 Claims, 12 Drawing Figures

FIG. 8
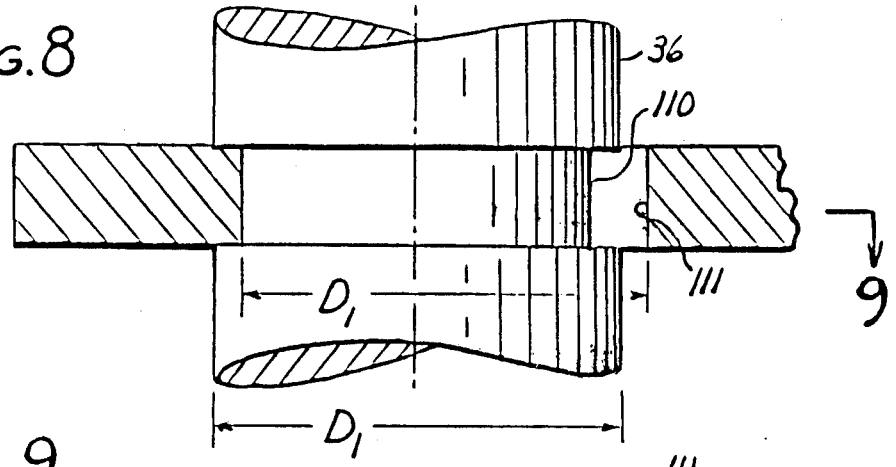
FIG. 9
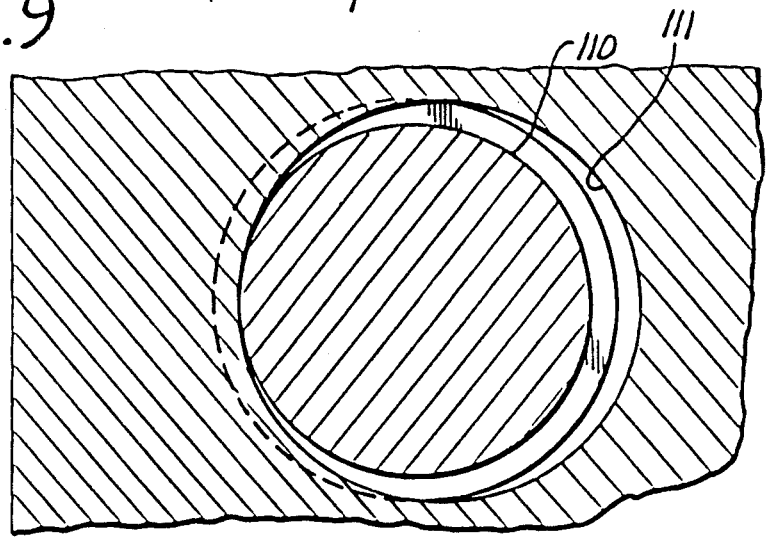
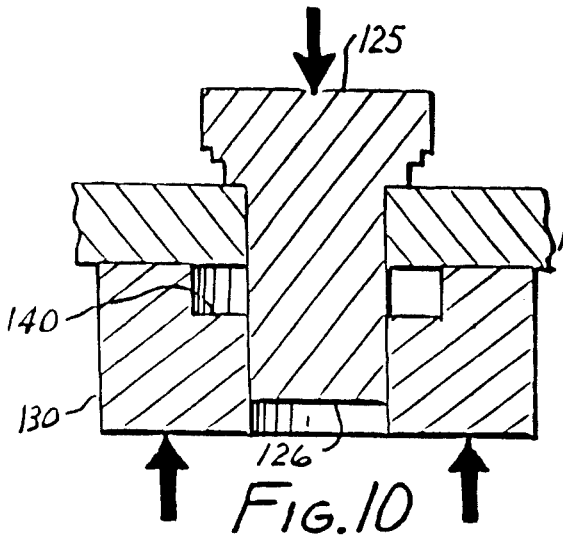
FIG. 10
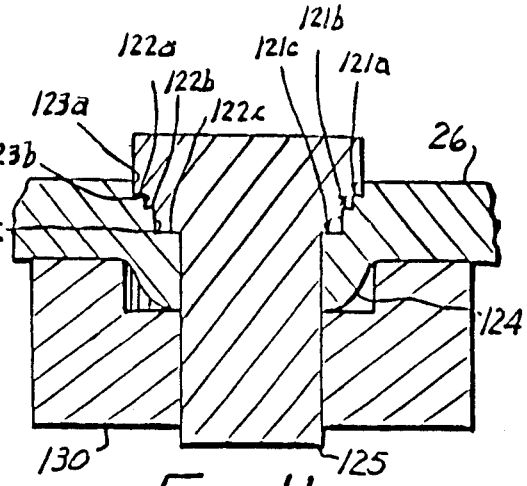
FIG. 11

METHOD FOR FORMING A COUNTERSINK IN A PLATE

CROSS-REFERENCE TO ANOTHER APPLICATION

This is a division of applicants co-pending application Ser. No. 562,849, filed Dec. 19, 1983, now U.S. Pat. No. 4,634,009, issued Jan. 6, 1987.

FIELD OF THE INVENTION

This invention relates to security racks, i.e., to racks for the purpose of holding articles and resisting the removal of the articles from the rack.

BACKGROUND OF THE INVENTION

The secure storage of valuable articles is a subject of long-standing interest. With the increased use of high value, conveniently-packaged articles of office equipment, the problems of theft have become even more severe than they used to be. For example, office computers and computer components are frequently packaged in rectangular boxes or cases which can readily be carried if they are loose. There exist means to attach such articles to a surface such as a table or a desk top, but there is a demonstrated need for a rack to hold such articles, so the articles can with authorized access readily be removed and replaced. Only the rack itself need be permanently affixed to the surface, instead of the articles themselves. This is much more convenient for installation, uses, removal, and servicing.

Such a rack must be strong enough that it will sufficiently frustrate or discourage unauthorized removal, which means that it must not readily be distorted or parted by means which are likely to be available to the thief. Such rigidity can, of course, be supplied by an extremely rigidly built rack, but such a rack is likely to be very heavy, very costly, not adapted to shipping in a knocked-down configuration, and not adapted to convenient assembly by the user. Thus, its cost is increased by excessive use of materials, costly assembly techniques, and large shipping costs.

It should be kept in mind that a security rack, to be successful, need not be totally impregnable. Instead, it must merely be able to frustrate the thief to the extent that he cannot remove and carry away the article within the relatively short response time inherent in alarm systems. Usually about five minutes from entry to departure is all that a professional thief will count on for his action.

Furthermore, it is not necessary that the security rack be totally rigid. In fact, it is suitable for there to be some deformability, but the the extent that deformability of rack structure is possible, it should result in destruction of the article's value to a fence, i.e., to a middleman who buy and sells stolen equipment. A corollary of this requirement is that there must be sufficient toughness of rack structure that the structure cannot be deformed or separated without having undergone such a change in shape as will have destroyed the value of the article. Then it is pointless for the thief even to start to invade the rack.

It is an object of this invention to provide a suitably strong security rack which can be manufactured with the use of simple and relatively inexpensive manufacturing techniques, which can utilize relatively unsophisticated materials of construction, and which can readily be shipped in a knocked-down configuration, and be easily assembled by the ultimate user, without special tools or skills, The consequence is a tough, reasonably priced, and superior security rack, as compared with previously known security racks.

BRIEF DESCRIPTION OF THE INVENTION

A security rack according to this invention traps articles of value or of interest between a plurality of plates, and in addition may externally support other articles while shrouding from the thief the means which hold it to the rack. The plates are generally parallel. The top and bottom plates (always there are at least two plates, and sometimes there are three or more) are attached to a plurality of rigid upright posts. Engagement means prevents the article from sliding relative to at least one of the plates. Then the article cannot be removed without moving one of the plates away from the other. When an article is externally supported, the means which attach it to the rack are shrouded by the rack and also by other articles from access by the thief.

A pair of anchor blocks are attached to each of the top and bottom plates. The anchor blocks on opposite plates face one another, and have post-receiving openings to receive the ends of the posts. Each top and bottom plate has a plurality of holes to pass the shank of a rivet and restrain the rivet head, and there are matching holes in the anchor blocks to receive the rivet shank, with a peripheral surface around those holes against which an upset rivet head is formed, whereby firmly to attach the anchor blocks to the plates.

A noncircular recess is formed in the anchor block, aligned with each respective post-receiving opening, adjacent to a shoulder. An internally threaded nut fits in this recess, trapped in it by the plate. Its axial thickness is less than the axial length of the recess, and it is held against rotation by engagement with the non-circular wall of the recess. The respective post is threaded at one end so as to be threadable into this nut to attach to it, and it has a limited amount of freedom for rotation while still making a strong connection.

The opposite anchor block on the other plate also has post-receiving openings, and a cross-hole intersecting them. The engaging end of each post at this end has a cross-hole, and the said limited capacity for rotation enables the cross-holes to be aligned. Then a lock pin is passed through all cross-holes to link the posts to these anchor blocks. Lock means releasably holds the lock pin in place, and is the release point for authorized access.

According to a preferred but optional feature of the invention, the post at the threaded end has an external shoulder which abuts the anchor block, and resilient means is placed between the nut and the peripheral surface, whereby to provide a more positive threaded joinder, coupled with the said limited capacity to be rotated, while still tightly holding and even more accurately locating the post in its axial direction.

According to yet another preferred but optional feature of this invention, the plates are made of a work-hardenable material, and the perimeter of the rivet holes in the plates is locally work-hardened and countersunk with a plurality of ring-shaped steps. The undersurface of the rivet head has concentric matching ring-like steps.

This invention also comprehends the press-forming in the plates of said ring-like steps, sequentially and gradually, with such force and at such a rate as plastically to deform the metal immediately adjacent to the hole, without causing a shearing action-type failure in the metal.

The above and other features of the invention will be fully understood from the following detailed description and the accompanying drawings, in which:

BRIEF DESCRIPTION OF THE DRAWINGS

FIG. 8 is a fragmentary section showing an alternate means for supporting an intermediate shelf;

FIG. 9 is a cross-section taken at lines 9—9 in FIG. 8;

FIGS. 10 and 11 are fragmentary cross-sections showing two steps in the formation of a portion of the plates.

DETAILED DESCRIPTION OF THE INVENTION

Figure 1:
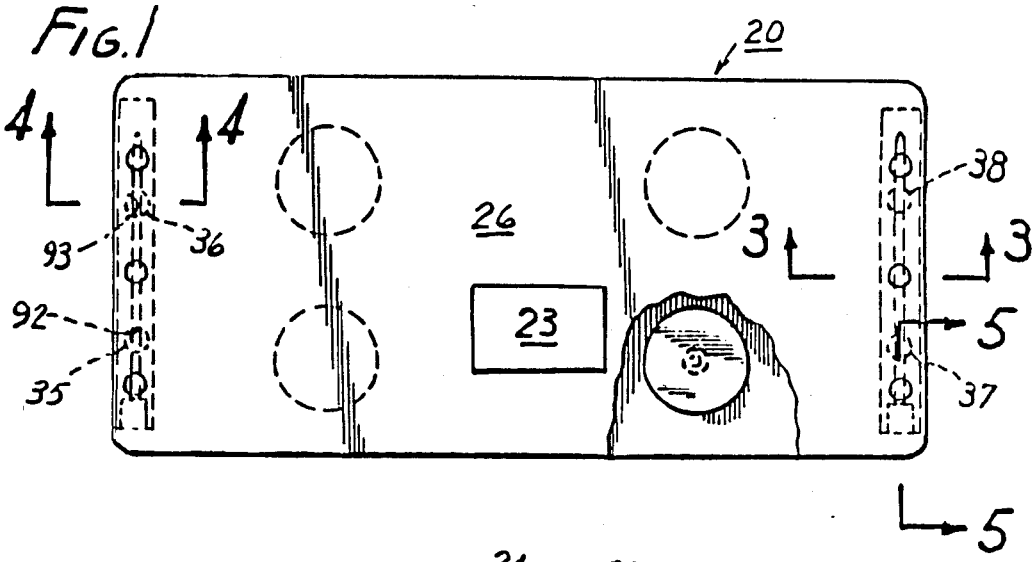
FIG. 1 is a top view, partly in cutaway cross-section, showing the presently-preferred embodiment of the invention.
Figure 2:
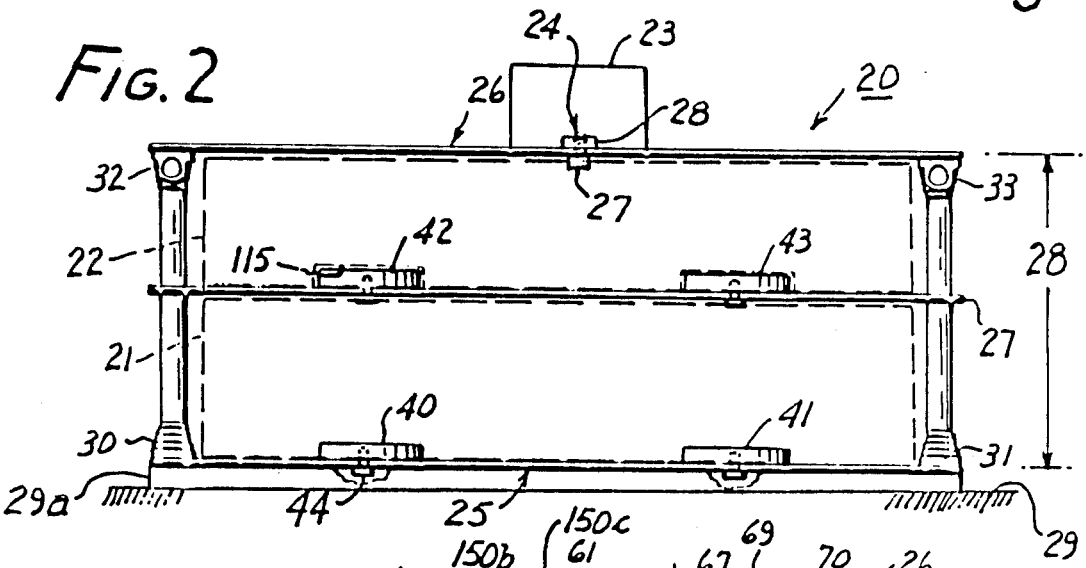
FIG. 2 is a side elevation of the rack of FIG. 1.

The presently preferred embodiment of security rack 20 is shown holding articles 21, 22 between plates, and article 23 on top of the top plate. Because the articles can be of any desired size and shape, and because there may be more or fewer of them, they are shown only in schematic notation. The purpose of the security rack is to hold articles disposed between the plates against sliding removal from between base plate 25 and top plate 26, and to shroud attachment means 24 that hold article 23 to the top plate. If it is desired to hold articles of lesser height than the space in between plate 25 and 26, or to hold two "layers" of articles, a shelf 27 can be placed between the base plate and the top plate in a manner yet to be described. Distance 28 is the vertical spacing between generally horizontal plates 25, 26. The articles to be retained have dimensions of length, width and height. It is the strong maintenance of the dimension of height which is relied on for the retention of the articles between the plates. This is accomplished by joining the plates to posts yet to be described.

Means 24 comprises a headed threaded fastener 27 passed upwardly through a hole in the top plate, and threaded into a nut 28 embedded in article 23.

The rack is placed on a table or desk 29, and may conveniently be securely mounted thereto by a pad **29*a*** such as is shown in Gassaway U.S. Pat. No. 3,850,392, which is incorporated herein by reference for its showing of such a means. Of course other means for attachment, such as screws or bolts can be used instead, if there is no objection to drilling through the top of the desk. There are also swivel mounts of this type, should the rack be desired to swivel, for example see Gassaway U.S. Pat. No. 4,361,305.

Anchor blocks 30, 31 are attached to base plate 25. Anchor blocks 32, 33 are attached to top plate 26. The anchor blocks are parallel to each other, and are positioned as opposed pairs. Thus, anchor blocks 30, 31 are parallel and opposed to each other, and anchor blocks 31 and 33 are parallel and opposed to each other.

Figure 4:
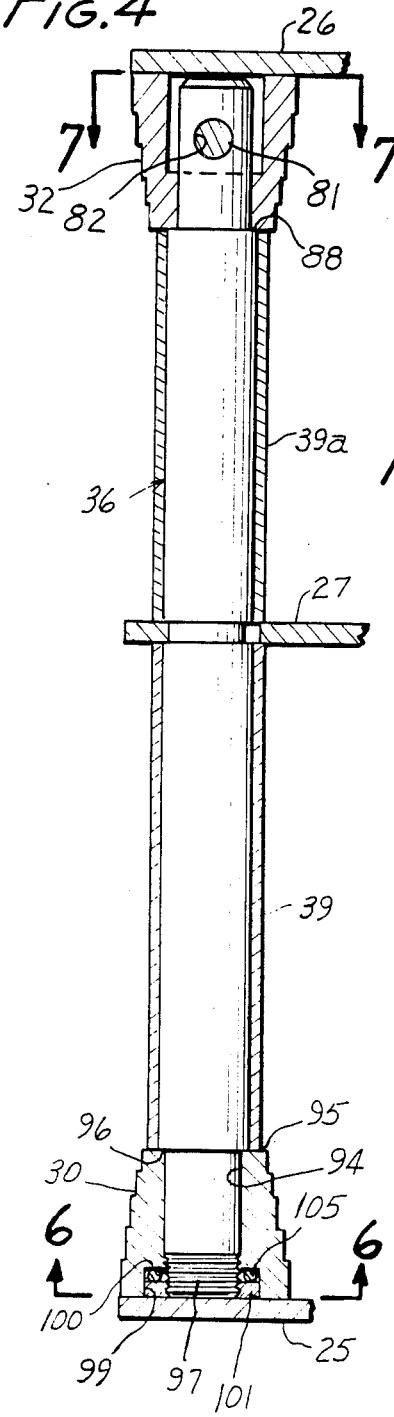

Posts 35 and 36 extend between and interconnect anchor blocks 30 and 32. Posts 37 and 38 extend between and interconnect anchor blocks 31 and 33. These are strong metal posts which are rigidly attached to the anchor blocks to hold the plates at established elevations relative to each other. When shelf 27 is used it is spindled into the posts through holes in the shelf, and the spacing of the shelf from the base plate is established by various means to be described. One such means is a sleeve 39 spindled on each of the posts between the base plate and the shelf, as shown in FIG. 4. As second sleeve **39*a*** is spindled onto each post, between the upper plate and the shelf.

Engagement means 40 and 41 are attached to base plate 25. Engagement means 42 and 43 are attached to shelf 27. These may be attached by means as simple as threaded fasteners 44 threaded upwardly through the base plate or shelf. The heads of the fasteners are inaccessible to an unauthorized person for reasons which will become evident. Similarly, fastener 27 is inaccessible, because it is inside the envelope of the plates and of the articles inside the plates. Of course it could be applied to the upper plate by a pad, the same as the pad attaching the base to the table.

Figure 3:
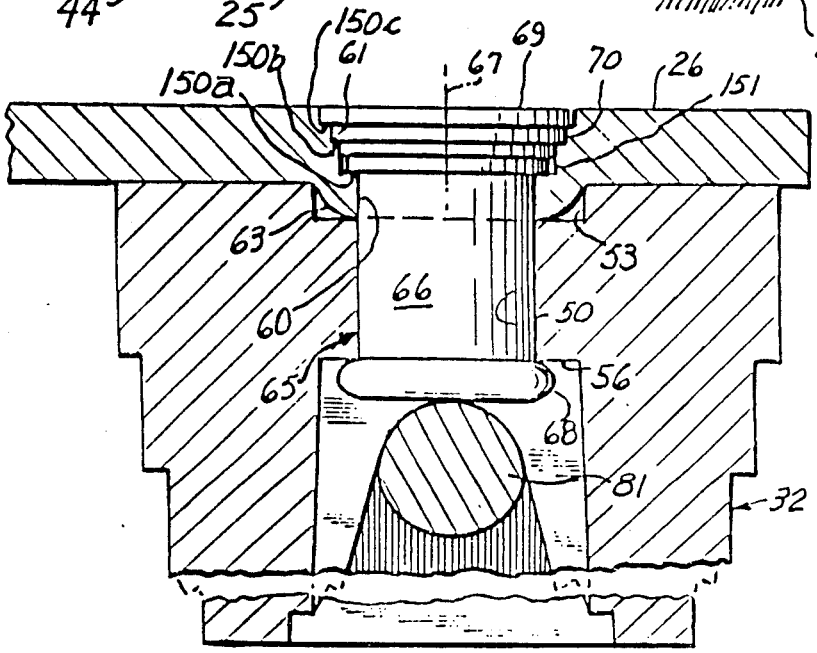
FIGS. 3, 4 and 5 are cross-sections taken at lines 3—3, 4—4 and 5—5, respectively, in FIG. 4.
Figure 7:
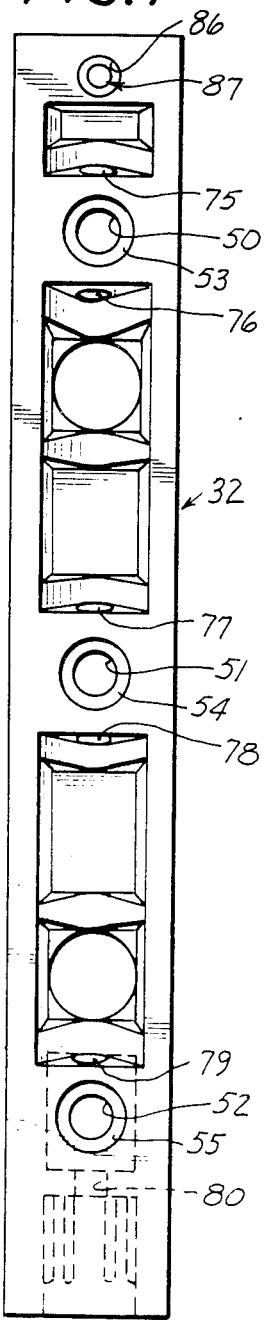

All of the anchor blocks are attached to the respective plates by rivets, and all of the rivets are identical. Therefore, only one rivet, the one relative to anchor block 32 and top plate 26, will be described in detail (FIG. 3). All other riveted joints (FIG. 7) are alike, and there are three for each anchor block. For example, anchor block 32 (see also FIG. 7), has three rivet holes 50, 51, 52. Each rivet hole is surrounded by a counter bore 53, 54, 55 on the side of the anchor block which faces the plate to which it is attached for a purpose yet to be described. At the opposite end of the rivet hole, there is a flat peripheral surface 56 in the nature of a counterbore.

The plate has a rivet hole for each rivet, in FIG. 3, rivet hole 60. This hole has a countersink 61 of a special kind. This countersink is in the exposed surface and will be described in detail later. In the opposite face of the plate there is peripheral raised portion 63 which is received in the counterbore 53. There is a rivet 65 in each rivet hole. The river has a shank 66, a central axis 67, and when installed, an upset head 68 which at least partially bears against the surface 56 in counterbore 53. The rivet also has a preformed head 69 with a bearing face 70 of a special shape which will later be described in detail. The anchor block is attached to its respective plate by inserting the rivet hole in the anchor block and then pressing the opposite end of the rivet to form an upset head. These rivets will effectively and strongly hold the anchor blocks to the plate.

In order to avoid cracking the anchor block, which usually will be a casting, by the rivet which usually will be an aluminum rivet with greater tensile strength, the rivet will initially have a loose fit, and will expand in the hole to make a reasonably tight fit. However, the upset head will have only a rather small area of contact with the anchor block—it is a rather gradual enlargement, as shown.

A plurality of lock pin receiving ports 75, 76, 77, 78, 79, 80 are formed longitudinally through anchor block 32 on top plate 26, normal to the rivet axis. The base plate does not utilize lock pins.

Figure 5:
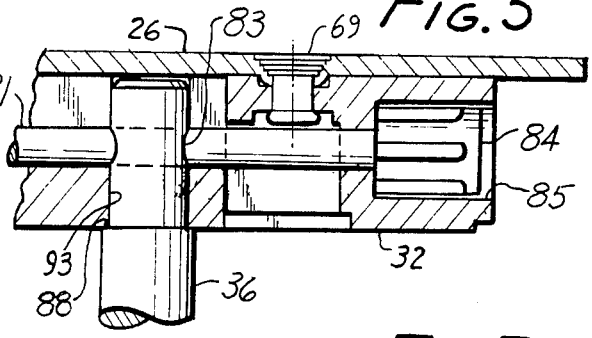

As can best be seen in FIG. 5, the ports at the top plate receive a lock pin 81 which passes through them and through a pair of post receiving openings 82, 83. Lock pin 81 passes through ports 75–80 and post receiving openings 82, 83 in order to hold two posts engaged to the anchor block by passing through their transverse cross holes. A releasable lock 84 is fitted in a lock recess 85 to retain the lock pin in the illustrated position. This retains the posts unless and until the lock is released, usually by a key or combination mechanism. A hole 86 is drilled in the path of the lock pin, and a hardened steel roll pin 87 or other hard object is permanently inserted therein to frustrate the passage of a drill toward the lock pin, because a drill will be deflected by and perhaps also broken by this roll pin.

The post-receiving openings receive the upper ends of the posts in a relatively tight fit. If desired, a shoulder 88 can be provided on the outside of each post to bear against the structure of the anchor block to make the system even more rigid.

Anchor block 33 is provided with the same provisions as anchor block 32.

Anchor blocks 30 and 31 are riveted to base plate 25 with the same constructions as the anchor blocks 32 and 33 are riveted to the top plate. They also are provided with a plurality of similar rivet holes 90 with counter bores 91 for the same purpose as heretofore described.

Because the posts are not attached to the anchor pads 30 and 31 by a lock pin at the base plate, lock pin receiving ports are not provided in anchor blocks 30 and 31. Both anchor block 30 and 31 are identical, so only block 30 will be described in detail. Two post-receiving openings 92, 93 are formed (See FIG. 4) with a cylindrical wall 94 and an upper shoulder 95 surrounding each respective post receiving opening. An optional external shoulder 96 on the post which faces downwardly near the lower end of each post bears against upper shoulder 95 for a reason yet to be described. Each post has a thread 97 at its lower end.

Figure 6:
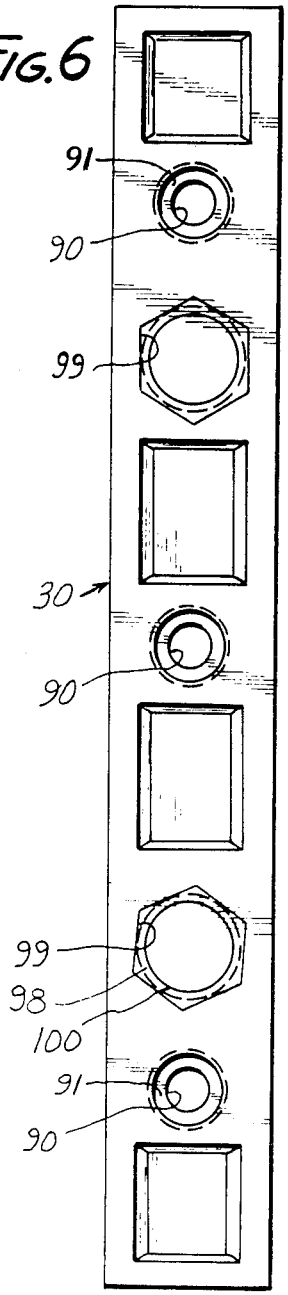
FIGS. 6 and 7 are cross-sections taken at lines 6—6 and lines 7—7, respectively, in FIG. 4.

Anchor blocks 30 and 31 have at the bottom end of each of their post receiving openings an enlarged recess 98 bounded by a noncircular inner wall 99 (see FIG. 6). In this case the inner wall is hexagonal, but other non-round shapes are acceptable. The recess has a dimension of axial depth in alignment with its respective post receiving opening, and it extends radially outward beyond the respective wall 94. A shoulder 100 is formed in the anchor block. In the assembled condition, it is positioned between the wall of the opening and an internally threaded nut 101 (see FIG. 4) located in each said recess. The walls of the nuts and recesses make a rotation resisting engagement with one another, and permit limited axial movement of the nut in the recess. The thread on the post is threaded into the respective nut. In the absence of a resilient ring yet to be described, turning the post will bring the shoulder of the post against the shoulder on the anchor block and the nut toward the shoulder in the recess, tightly to mount the post to the base plate and most accurately to locate the post axially relative to the anchor plate. Furthermore, shoulder 96, while limiting the downward movement of the post, prevents it from pressing against the base plate and deforming it, or from applying lifting forces on the anchor plate. However, shoulder 96 is optional, and the installer will simply need to be more accurate and careful in making the assembly if it is not provided.

A limited rotational movement of the post is available for purposes of aligning the lock pin receiving holes with the lock pin, but this could tend to allow the post to become slightly loosened and also, should it be overtightened, might cause damage to the anchor block. Therefore, although it is optional, it is best practice to provide resilient means 105 (See FIG. 4), preferably in the form of a resilient elastomeric ring between nut 101 and shoulder 100. When the post is tightened down on the nut, the nut is drawn agaist the ring, which will be deformed somewhat, but there will be a substantial range of positions of the axial nut which still will result in a very tight joinder of the post to the anchor block, certainly within the degrees of rotation that might be required in order to line up the pin receiving ports and the lock pins. The resilient means presses back strongly to maintain the assembled tightness. Nut 101 need not have a particularly large axial length, and in fact is is preferably not more than about $\frac{1}{8}$ to about $\frac{3}{8}$ thick. Thus, the interposition of ring 105 enables a tight joinder to be made, while still permitting a sufficient range of rotational adjustments so that the rack can be quickly, accurately, and easily assembled. This enables the rack to be shipped in its knocked-down condition, at great savings in storage space and freight costs.

When shelf 27 is used, it can rest atop sleeve 39 in one embodiment of the invention. Obviously the top of the sleeve can be located wherever desired to a accommodate articles of known height merely by providing posts of appropriate length. The upper sleeve fills in above the shelf, so the shelf cannot be slid up or down. Posts of different lengths can be provided to accommodate total heights of multiple layers of articles, or of only one layer of one article when the height of the article might vary. Usually a rack model will be established for the storage of standard articles. In the definitions herein, the shelf is not treated as a plate, but as a separate item between the plates, However, a plurality of vertically spaced articles are treated as a single article in the definitions.

An optional means to support the shelf without requiring sleeves is shown in FIGS. 8 and 9, wherein a peripheral groove 110 is formed in the wall of the post. When the groove is provided, the sleeves are omitted. Both are shown in the single drawing to simplify the disclosure. The post has a major diameter D1. There is hole 111 through the shelf having a diameter just enough larger than D1 to pass the post. However, the spacing apart of the posts is greater than the spacing apart between the holes in the shelf, so that the posts must be slightly sprung to pass the shelf to the grooves, and then will spring back as shown in FIG. 8. The shelf hole is offset from the center of the post, and the shelf at the hole edge is trapped in the groove. When the lock pins are fully installed, then the posts can no longer be sprung to free the shelf for movement along the posts, and is therefore held firmly against movement along the posts. The reverse arrangement of offset can instead be successfully used, depending on problems and objectives.

Figure 12:
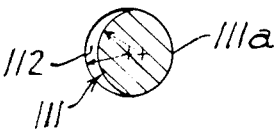
FIG. 12 is a fragmentary cross-section of one of the posts, showing an alternative groove configuration.

FIG. 12 shows that the groove on the post need not by fully peripheral. Instead, groove 111 in a post 111*a* may itself be an offset shape, having in section a "new moon" shoulder 112 against which the shelf will bear. Such a groove is easily made on a lathe, using a cam to displace the tool or cutter, or by offsetting the post in the chuck. The centers of the groove bottom and of the post are offset is shown. The radii of curvature are approximate equal.

It is not necessary to provide means such as grooves to support the shelf. Instead it could rest directly upon a suitably strong article, but this assumes the risk of possible damage to the article if someone strongly strikes the shelf, which in turn would strike the article.

The shoulders on the posts or the sleeves, as provided, will protect the articles from this risk.

It will now be seen that this device can readily be shipped in a knocked down condition without any prior assembly other than the attachment of the anchor blocks to the base plates (which is best done at the factory). Assembly requires no more skill or effort than threading the posts into the nuts in the anchor blocks on the base plate, until a sufficiently tight joinder is made, and then turning the posts in one direction or the other so as to align the cross-holes with the lock pin receiving ports in the upper anchor plates. The article is then placed in the spacing between the posts. The article conventionally has a recess 115 whose walls surround the engagement means on the shelf or on the base plate. Then the shelf or base plate as appropriate is applied. When a shelf is used, the next article is placed above it, and then the top sleeves (if used) and the top plate are spindled onto the top of the four posts. The lock pins are next inserted through the ports and openings, the lock is secured, and the assembly is complete.

Because the height of the article is such that it cannot be lifted off of the engagement means because of the presence of the shelf or of the top plate, and cannot be slid out because of the engagement means, the articles or articles are firmly retained. The only means of getting an article out is to spring the plates apart which is not practical because of the high strength of the assembly, or of attempting to bend or distort the structure which is very difficult because the structure is so very tough and in any event cannot be done withoot destroying the value of the article. The assembly is a strong parallelogram structure along two non-parallel axes, and it is most diffficult to distort it sufficiently to damage the articles. The fastening means to the engagement means through the shelf and through the top plate are protected by the articles below. The engagement means below the bottom plate are protected by securing the rack to the table or desk, as already described. Instead the rack could be screwed or bolted to the desk or table, from above, if preferred.

In addition to its advantage of being shippable in the knocked-down condition (which was not practical in previously known security racks), this security rack has the advantage of unusual toughness and rigidity. This additional toughness and rigidity is derived in part from the threaded attachment of the posts to the base plate, and also to an unusual rivet and rivet joint construction which will now be described.

The toughness of this security rack is largely dependent upon the integrity and strength of the joinders between the anchor blocks and the top and base plates. There are many ways to make strong joinders, but it should be remembered that a principal objective of this invention is to provide not only an optimum security rack, but an affordable one. The ability to make it form relatively inexpensive materials of construction, to process these materials with few manufacturing steps that are very economical, and to enable the rack to be set up from a knocked-down configuration, thereby saving on in-plant assembly costs, and on shipping costs, are prime objectives. The shipping costs will be reduced because of the lesser bulk occupied compared to known devices where at least the posts have been pre-assembled to at least one of the plates.

This invention can utilize inexpensive low carbon steel for the plates, such as 1018 carbon steel treated to about 40,000 psi tensile strength. The steel for the plates is selected for its work-hardening property. Using the process disclosed herein, a special countersink (socket) can be provided to accept the rivet and react with it to form an optimally tough joinder. With this process, the special socket shape can be formed without wrinkling the plate, and therefore without need later to straighten or flatten the plate. This is a substantial savings. A plate about 0.130 inches thick is suitably strong for this invention.

The rivet is preferably an aluminum alloy rivet with a shank diameter of about 5/16". It should be heat treated to about 67,000 psi tensile, and should have shear strength about equal to it.

The counter sink (sometimes called a "socket") 61 in the plates at each rivet joint is best shown in FIG. 3. It is a depression formed as a recess from the exposed (or outside) surface of the plates. In order to provide for most reliable retention of articles, as well as attractiveness for sales, the exposed plate surface must be smooth. A simple frustonconical counter sink formed by conventional countersinking tools by removal of metal would undesirably reduce the strength of the joint, or alternatively require an increase in thickness of the plates, and would require machining operations for its manufacture which importantly increase the cost and which require later clean up of chips and the like. Displacement of the metal, with retention of this metal, accompanied by hardening of the interface region with the rivet, enables one with this invention to obtain the most strength from a plate of a given thickness, and to use plates of minimum thickness for the device. Thus, the socket provided by this invention noy only saves material and weight, but provides a toughened joinder. Furthermore, with proper design the punch to make this socket can last for tens of thousands of parts, and is very affordable.

As shown in FIGS. 3 and 10, a plurality of ring like steps, 121*a*, 121*b*, 121*c*, are formed in the surface. Steps farther from the exposed surface have smaller diameters than steps nearer to the exposed surface. Each step has a respective substantially flat base surface 122*a*, 122*b*, and 122*c*, and a circular side wall surface 123*a*, 123*b*, and 123*c*. Step 121*a* is wider than either of steps 121*b*, and 121*c* (which have substantially equal widths). Side wall surface 123*a* is axially longer than sidewall surface 123*b* and 123*c* (which are about equal in length). The punch 125 which forms the step and surfaces has, of course, a generally similar shape to the surfaces which it generates, and the side wall surfaces which form surfaces 123*a*, 123*b*, and 123*c* are substantially cylindrical, with little or no draft angle. The day may come when the punched surfaces that form the steps can be negatively undercut so as to provide something of a "rake", and this will improve the device, but an economical tool for that purpose is not now known to exist. The larger bottom step and side wall for some unknown reason, appear to improve the quality of the counter sink and the life of the punch.

A peripheral, raised ring 124 of material, is displaced downwardly from the "back" face of the plate. It is accommodated in the counter bore 54 in the anchor block. As shown in FIG. 3, it fits neatly at its edges into the counter bore, and this further assists in locating the parts relative to each other and holding them in that relative location.

The formation of the sockets is shown in FIGS. 10 and 11. The punch 125 has a stem 126, and a plurality of circular steps, each having a larger diameter than the one closer to the stem from it. These are complementary to the surfaces, steps and side walls described above. The stem survives longer if it is cylindrical or very nearly so without substantial draft angle. A support die 130 is shown supporting plate 26 during the process of forming the socket. The other plate is similarly processed. Optionally, a second die (not shown), could clamp the plate against die 130 still further to reduce the risk of wrinkling. It would pass and closely surround punch 125 and bear against a substantial area of the plate around the punch. In fact, the dies could be platens that are coextensive with the plates, ported only for the punches, and relieved to receive the displaced material. All recesses and holes can be formed simultaneously, which is a substantial economy in the manufacture of this device. In fact, it requires less than 20 seconds full cycle time to form a top or a bottom plate, with all holes and other features formed simultaneously in a single press stroke. Furthermore, there are no chips to clean up.

This process does not form a dimple. It will be noted that during most or all of the press formation of the socket, the lower surface around the hole is not supported. Its axial excursion may be limited by the base surface 140 in the die, but the major portion (and often all) of the ring will assume a shape determined by displacement of steel, rather than by trapping it between two dimpling surfaces. Also, the process is not a typical die-stamping or perforating operation. Such conventional operations are quite rapid, and usually take only about 0.01 seconds. In contrast, this is a slow-action press-forming process which gradually displaces material, with dissipation of heat, and without shearing action. In fact, it should take at least two seconds and sometimes longer.

Dissipation of heat lengthens tool life. Deformation of material without shearing results in maximum workhardening to about 72,000 psi, rather closely matching that of the rivet.

The axial length of side walls **123*b* and 123*c* is preferably about ½ of the length which would cause a shearing action. Thus, ina socket for about 5/16" diameter countersink rivet, two side walls each about 0.040 inches long, is quite suitable. The bottom side wall 123*a* may conveniently be about twice that length without unfavorable effects. In fact providing a longer side wall 123*a* and a wider step 121*a*** appears to result in an easier manufactured socket and longer punch life. The reasons for this are not understood.

The sockets described above can economically be formed in a simple hydropress, and the plates will be entirely ready for use without any post-treatment such as deburring, straightening, or flattening.

Step **150*a* (FIG. 3) on the rivet head abuts about the inner ½ of the width of step 121*a*. Steps 150*b* and 150*c* closely match steps 121*b* and 121*c*. There is a void 151 just above the outside half of of the width of step 121*a***. This is a close match, generally, and the rivet head is strongly and accurately held in the socket. In contrast with a simple frusto-conical countersink, there is no tapered relationship between the rivet head and the socket. Thus, eccentric peel-out is prevented. Now when the rivet is set, the anchor blocks are so reliably held that they cannot be peeled loose. This assures integrity of the rack. Simple countersink head rivets and a simple countersink could be used, but this would forfeit some of the valued rigidity of the assembly.

In addition, the threaded joinder of the posts to the anchored blocks on the base plate is also strong and rigid. It strongly resists axial removal, is readily installed, and resists bending or peel out.

The consequence of the foregoing is a security rack that can be made very economically, shipped in knocked-down condition, and where it most counts, i.e., at the attachment of the anchor blocks to the plates and the posts to the anchor blocks, is very strong.

This invention is not to be limited by the embodiments shown in the drawings and described in the description, which are given by way of example and not of limitation, but only in accordance with the scope of the appended claims.

I claim:

1. A method to form a countersink in a plate having a pair of parallel surfaces, a hole through said plate between said surfaces, said plate being made of a material which can be workhardened, said method comprising:

utilizing a punch having an axis, an axially extending substantially circularly cylindrical stem and a peripheral head adjacent to said stem, said head having a pressure face adjacent to said stem, coaxial therewith, and projecting radially beyond it, said pressure face having a plurality of ring-like steps, each step having a substantially flat base surface and a substantially circularly cylindrical peripheral wall surface, the diameter of each step farther from said stem being larger than the diameter of its continguous step that is close to said stem, said stem having no radial dimension larger than the dimension contiguous to the step closest to said stem;

leaving unrestrained an annular ring of one of said plate surfaces contiguous to said hole, and restraining said one surface against axial displacement around said ring, whereby the metal within said ring is capable of limited axial displacement;

pressing said punch into said hole, stem first, the diameter of the stem closely approximating the diameter of the hole, continuing to press the punch into said hole with such a force and at such a rate as to cause deformation, but not shearing, of the metal, whereby the steps indent into the other of said plate surfaces to form a stepped countersink with coldworked surfaces, and the material inside said ring deforming downwardly to form a raised ring, and the diameter of the hole below said countersink equallying that of the stem; and withdrawing the punch from the plate.

2. A method according to claim 1 in which the axial length of at least one of said steps is about one-half the length which would cause shear removal of metal if used.

* * * * *